United States Patent [19]

Klubitschko

[11] Patent Number: 4,463,967

[45] Date of Patent: Aug. 7, 1984

[54] SKI BRAKE HAVING DETACHABLE PEDAL

[75] Inventor: Gerd Klubitschko, Oberau, Fed. Rep. of Germany

[73] Assignee: Marker-Patentverwertungsgesellschaft mbH, Baar, Switzerland

[21] Appl. No.: 441,667

[22] Filed: Nov. 15, 1982

[30] Foreign Application Priority Data

Nov. 17, 1981 [DE] Fed. Rep. of Germany ..... 3145646

[51] Int. Cl.[3] ..... A63C 7/10

[52] U.S. Cl. ..... 280/605

[58] Field of Search ..... 280/604, 605, 601, 618

[56] References Cited

U.S. PATENT DOCUMENTS

| | | | |
|---|---|---|---|
| 4,014,563 | 3/1977 | Weigl et al. | 280/605 |
| 4,337,964 | 7/1982 | Biermann et al. | 280/605 |
| 4,379,570 | 4/1983 | Sedlmair | 280/605 |

FOREIGN PATENT DOCUMENTS 11572B 2/1979 Italy .

*Primary Examiner*—Joseph F. Peters, Jr.
*Assistant Examiner*—Michael Mar

[57] ABSTRACT

A ski brake including a pair of legs each having a free end on a lower arm and an end section on an upper arm, a housing to which the legs are pivotally attached, a pedal including a receptacle having an access for releasably engaging the end sections of the legs and a connection between the pedal and housing.

10 Claims, 2 Drawing Figures

SKI BRAKE HAVING DETACHABLE PEDAL

The invention herein relates to brakes for skis and particularly to ski brakes used with safety ski bindings.

All of the following pending U.S. patent applications involve ski brakes and are assigned to the assignee of this application: Ser. No. 198,133 filed Oct. 21, 1980, now U.S. Pat. No. 4,366,968 for Combination Ski Boot Retainer and Ski Brake; Ser. No. 358,372 filed Mar. 15, 1982 for Ski Brake; Ser. No. 368,276, filed Apr. 14, 1982 for Ski Brake and Ser. No. 407,098 filed Aug. 11, 1982 for Improved Ski Brake.

A ski brake is intended to prevent a ski that has been separated from a skier's boot from continuing down a ski slope. Generally, a ski brake has a pair of legs formed in mirror images of each other from rods or heavy wire. The legs are pivoted near their midpoints on top of the ski. A pedal attached to the upper end of each of the legs is driven, against a pedal biasing force, toward the ski by the pressure of a skier's boot. That movement raises the lower, free ends of the legs above the top surface of the ski to the skiing position. When the ski boot pressure is released, the lower free ends are pivoted by the biasing force to a position below the bottom surface of the ski where they are intended to dig into the snow and brake the ski. Preferably, the free ends of the legs move toward each other as they are pivoted above the top surface of the ski so that they do not snag objects during skiing.

Typically, ski brakes are mounted on a ski in conjunction with a ski binding. From time to time various adjustments to or servicing of the binding and brake are necessary. Because of the biasing force on the ski brake, the free ends of the ski brake legs remain below the bottom surface of the ski, except during skiing. As a result, the legs get in a technician's way when bench servicing and adjustments are attempted unless a special clamping fixture is used or the brake is removed from the ski. Both the use of a special fixture and removal of the brake are undesirable because of the expense and time involved.

SUMMARY OF THE INVENTION

In the present invention the pedal of a ski brake includes a receptacle for receiving and engaging the end sections of the upper arms of the legs of a ski brake. The receptacle includes an access on the underside of the pedal through which the upper ends of the legs may be passed. The pedal may therefore be releasably engaged in or disengaged from the pedal. When a ski or ski binding including the inventive ski brake is to be serviced, the pedal may be disengaged from the legs and the legs pivoted out of the way to permit placing the ski flat on the service bench without use of a special clamp or removal of the brake from the ski.

The upper arms include opposing end portions which have a reduced diameter so that a shoulder is formed. A spring or other biasing means is slipped over the opposing ends bearing on the shoulders to urge the opposing ends apart. The underside of the pedal includes transverse surfaces which engage the upper arms when the pedal is moved toward the ski. The transverse surfaces form guides for squeezing the legs together when the pedal is moved toward the ski so that the legs do not protrude beyond the edges of the ski when the pedal is fully pressed down to the ski. Conversely, when the pedal rises from the ski, the guides partially disengage from the legs so that their lower ends spread. The spreading allows the lower legs to pass by the edges of the ski and their free ends to come to rest below the ski.

DETAILED DESCRIPTION OF PREFERRED EMBODIMENT

Figure 1:
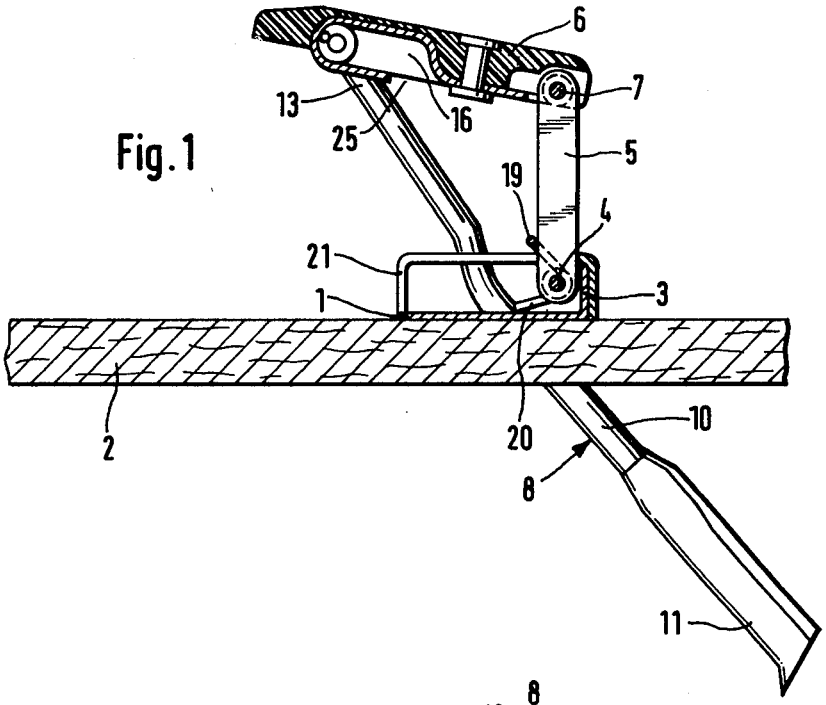
FIG. 1 is a cross sectional side view of an embodiment of a ski brake according to the invention mounted on a ski.
Figure 2:
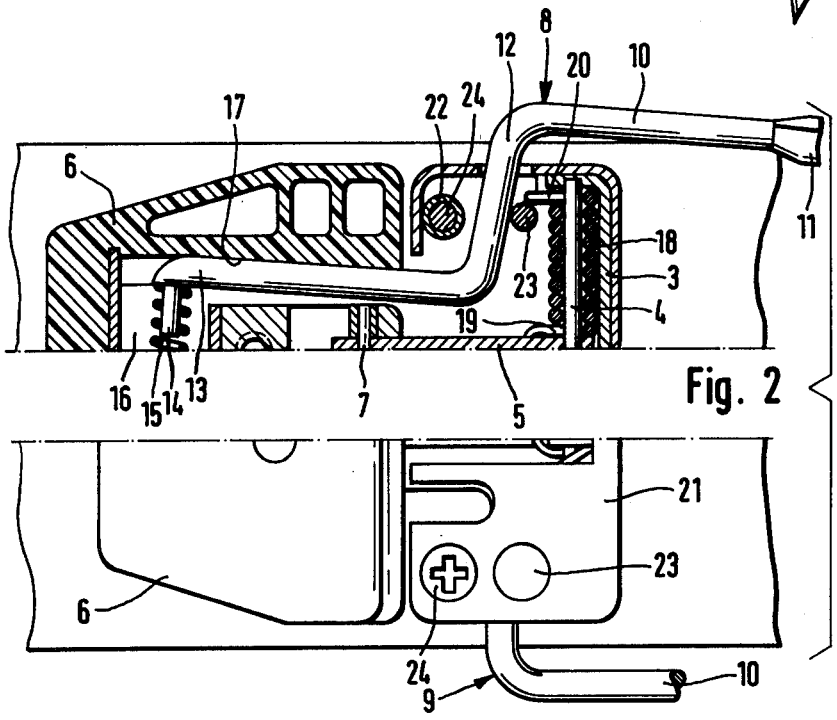
FIG. 2 is a partially sectioned top view of an embodiment of a ski brake according to the invention. In the upper half of FIG. 2, the embodiment is shown in section with the pedal resting on the ski; in the lower half of FIG. 2, the embodiment is shown with the pedal released as in FIG. 1.

An embodiment of a ski brake according to the invention is shown mounted on a ski in a sectional view in FIG. 1. The ski is shown in a horizontal position and the sectioning plane is vertical. In FIG. 1, the brake is shown in its braking position with its legs extending below the skiing surface of the ski and its pedal raised above the upper surface of the ski on which a binding and ski boot are placed. In FIG. 2, a split top view of the same embodiment of the inventive ski brake is shown. In the lower half of FIG. 2, the top view is of the brake in the braking position, just as shown in FIG. 1. In the upper half of FIG. 2, the brake embodiment is shown in its skiing position with the pedal resting on the upper surface of the ski. The upper half of FIG. 2 is sectioned to show the internal construction and elements of the pedal and housing. In the description that follows, reference is made generally to the figures in which like elements are given similar reference numerals.

The embodiment of the ski brake shown includes a base plate 1 which rests on and is attached to the top surface of a ski 2, in a conventional manner. Base plate 1 has a wall 3 generally perpendicular to the base plate which with a cover 21 forms an attaching means for the ski brake. Wall 3 pivotally engages the opposite ends of an axle 4 which is transverse with respect to ski 2. Ski 2 has toe and heel ends, which lie toward the left and right of edges of the figures; the direction along the length of ski 2 is referred to here as longitudinal and the direction generally pependicular to the length of ski 2 is referred here as transverse.

A connection in the form of a longitudinal link 5 is firmly attached at one of its ends to axle 4. At its opposite end, link 5 is firmly connected to pedal 6 along a shaft 7 which is rotatable in pedal 6. Shaft 7 is preferably located near the heel end of pedal 6. Two legs 8 and 9, which are generally symmetrical about a medial vertical plane, are attached to pedal 6 near its toe end. The legs are formed from heavy wire or rods, each bent to have a lower arm 10 terminating in a free end to which a spur-like termination 11 is fixed. Spur 11 may be a molded plastic element which snugly engages the leg. Each leg is bent between the lower end and its upper ends 13 so as to form a generally transverse section 12 which engages one of the opposing notches in wall 3. The upper arm 13 of each leg is generally longitudinal in direction but, as viewed toward the toe end of the ski 2, diverges from the medial vertical plane of ski 2 towards its nearest outside longitudinal edge. Each upper arm 13 terminates in an opposing transverse end section 14 which is preferably of reduced diamter to form a shoulder. A helical spring 15 surrounds the opposing end portions, bears on the shoulders and urges the upper arms apart. The pedal includes a receptacle 16 which receives and releasably engages the opposing end sections 14 and spring 15.

On the underside or bottom side of pedal 6, i.e. the side of pedal 6 opposite ski 2, the pedal includes opposing guide surfaces 17 which diverge in the manner of the upper arm 13 for engagement with arms 13. The guide surfaces are transverse to the opposing bottom and top sides of pedal 6.

A helical spring 18 surrounds axle 4 and includes a loop 19 near its center which engages link 5. The free ends 20 of spring 18 bear on base plate 1 so that loop 19 urges link 5 into the upright position shown in FIG. 1, raising pedal 6 off ski 2.

Cover 21 is preferably held on to base plate 1 by hollow rivets 22 and 23. Screws 24 may be passed through rivets 22 to attach the brake firmly to ski 2. Fivets 22 and 23 confine the movement of sections 12 of legs 8 and 9 as the legs are pivoted.

At the heel end of receptacle 16, there is an access 25 on the bottom side of pedal 6. The opposing ends 14 of the upper arms of legs 8 and 9 may be passed through access 25 to be received by or withdrawn from receptacle 16.

When the ski brake is in the braking position as shown in FIG. 1, legs 8 and 9 extend below ski 2 so that spurs 11 may dig into the snow and brake movement of the ski. Obviously, the spurs must then be separated by a distance wider than the width of ski 2. When a skier uses the ski brake, he steps on pedal 6 pressing it toward ski 2. Legs 8 and 9 pivot, generally around their sections 12, and link 5 pivots against the biasing force of spring 19. As the pedal approaches ski 2, guide surfaces 17 engage and squeeze upper arms 13 toward the center line of ski 2 against the biasing force of spring 15. The compression of upper arms 13 results in a convergence of spurs 11 after they pass by ski 2 so that in the skiing position the spurs do not protrude beyond the outside edges of the ski.

When pedal 6 is moved from the braking position shown in FIG. 1 to the skiing position shown in the upper half of FIG. 2, opposing ends 14 of the upper arms 13 move toward the heel end of ski 2 within receptacle 16, relative to the position of FIG. 1. The biasing force of spring 19 tends to maintain pedal 6 in the braking position of FIG. 1. If a binding mounted on ski 2 is to be serviced, spurs 11 interfere with placing the ski on a bench. However, by manually lifting the toe end of pedal 6 away from ski 2 and manually pivoting legs 8 and 9, clockwise in FIG. 1, opposing ends 14 and spring 15 move longitudinally within receptacle 16 and can be passed through access 25 in pedal 6. The legs and pedal are then disengaged and the legs can be pivoted out of the way to allow bench servicing of the ski and any attached equipment. The heel end of pedal 6 is still held up by link 5, of course. By following the reverse procedure, opposing ends 14 and spring 15 can be inserted into access 25 for engagement by receptacle 16 for use of the brake during skiing.

The invention has been described with reference to a particular embodiment. Those skilled in the art will recognize various modifications and additions without departing from the spirit of the invention. Therefore, the scope of the invention is limited solely by the following claims.

I claim:

1. A brake for a ski, said brake having longitudinal and transverse directions and comprising:

attaching means for attaching a ski brake to a ski;

a pair of legs, each leg having a lower arm terminating in a free end and an upper arm terminating in an end section, said legs being pivotally connected to said attaching means and said end sections being transversely opposite each other;

pedal means releasably engaging said ends sections of said legs for pivoting said legs and for moving longitudinally relative to said legs in response to pressure applied to said pedal means, said pedal means including opposing top and bottom surfaces and receptacle means including a chamber for releasably engaging said end sections and access means including an opening in said bottom surface and communicating with said chamber through which said end sections of said upper arms may pass; and connecting means for movably interconnecting said attaching means and said pedal means;

wherein said pedal means is movable between a lower skiing position and an upper braking position, and said pedal means having opposing fore and aft ends, the fore end of said pedal means being manually movable to a raised position when said pedal means is in the braking position to enable manual movement of said end sections of said upper arms in the longitudinal direction relative to said pedal means for rendering the end sections of said upper arms accessible for disengagement from said pedal means.

2. The invention of claim 1 further including spring means engaging said opposing end sections for urging said opposing end sections apart.

3. The invention of claim 2 wherein said spring means comprises a helical spring surrounding each of said opposing end sections.

4. The invention of claim 2 wherein said upper arms include diverging portions extending from said opposing end sections and said pedal means includes guide means for engaging said diverging portions and for driving said end sections toward each other when said pedal means is moved toward a ski on which housing means is mounted.

5. The invention of claim 4 wherein said pedal means includes opposing top and bottom surfaces and said guide means comprises surfaces on said pedal means, said surfaces lying transverse to said top and bottom surfaces.

6. The invention of claim 1 wherein said connecting means comprises a link having first and second ends, said first end being pivotally connected to said attaching means and said second end being pivotally connected to said pedal means.

7. The invention of claim 6 wherein said second end of said link is pivotally connected to said pedal means near its said aft end.

8. The invention of claim 7 wherein said receptacle means is located near said fore end of said pedal means.

9. The invention of claim 1 further including biasing means bearing on said connecting means for urging said connecting means to move said pedal means away from a ski on which said attaching means is mounted.

10. The invention of claim 9 wherein said biasing means comprises a coil spring having a medially protruding loop, said loop bearing on said connecting means.

* * * * *